US005392823A

United States Patent [19]

Sternheimer et al.

[11] Patent Number: 5,392,823

[45] Date of Patent: Feb. 28, 1995

[54] DRAIN CLEANER DISPENSER WITH LOCKING FEATURE

[75] Inventors: Arthur Sternheimer, Spring Valley, N.Y.; Anthony Delia, W. Redding, Conn.

[73] Assignee: Block Drug Company, Inc., Jersey City, N.J.

[21] Appl. No.: 110,315

[22] Filed: Aug. 23, 1993

Related U.S. Application Data

[60] Division of Ser. No. 824,160, Jan. 22, 1992, Pat. No. 5,251,559, which is a continuation-in-part of Ser. No. 681,953, Apr. 8, 1991, Pat. No. 5,253,684.

[51] Int. Cl.[6] ..... B67D 5/00

[52] U.S. Cl. ..... 141/1; 141/98; 141/329; 141/312; 141/363; 141/375; 222/87; 222/81; 222/83.5; 220/267; 220/277; 215/297

[58] Field of Search ..... 141/1, 329, 330, 98, 141/312, 363–366, 369, 375, 383; 222/83, 83.5, 87–90, 81; 30/123, 124; 220/260, 267, 277; 215/297, 206

[56] References Cited

U.S. PATENT DOCUMENTS

| | | | |
|---|---|---|---|
| 4,060,105 | 11/1977 | Feldersen et al. | 141/1 |
| 4,311,174 | 1/1982 | Walsh, III | 141/383 |
| 4,600,125 | 7/1986 | Maynard, Jr. | 222/81 |
| 4,614,437 | 9/1986 | Buehler | 215/250 X |
| 4,969,491 | 11/1990 | Kiplinger | 141/1 |
| 4,970,817 | 11/1990 | Mansfield | 141/98 X |
| 5,027,872 | 7/1991 | Taylor et al. | 141/329 X |
| 5,071,035 | 12/1991 | Kiplinger | 222/83.5 |
| 5,152,428 | 10/1992 | DiGerolamo | 222/80 |
| 5,251,559 | 10/1993 | Sternheimer et al. | 141/98 |
| 5,253,684 | 10/1993 | Sternheimer et al. | 141/329 |

*Primary Examiner*—Ernest G. Cusick

*Attorney, Agent, or Firm*—Ostrolenk, Faber, Gerb & Soffen

[57] ABSTRACT

A method of cleaning a drain by unlocking and opening a container within a dispenser and dispensing drain cleaner from the container, through an outlet of the dispenser, and into the drain. The dispenser may have an upwardly extending pin for opening the container. Alternatively, the dispenser may have a cutter for opening an angled end of the container. In another alternative, the container may include a plug and a cooperating stem for opening the bottom of the container. A mechanism for locking the dispenser in an unused state is included in the dispenser.

5 Claims, 6 Drawing Sheets

FIG. 6.
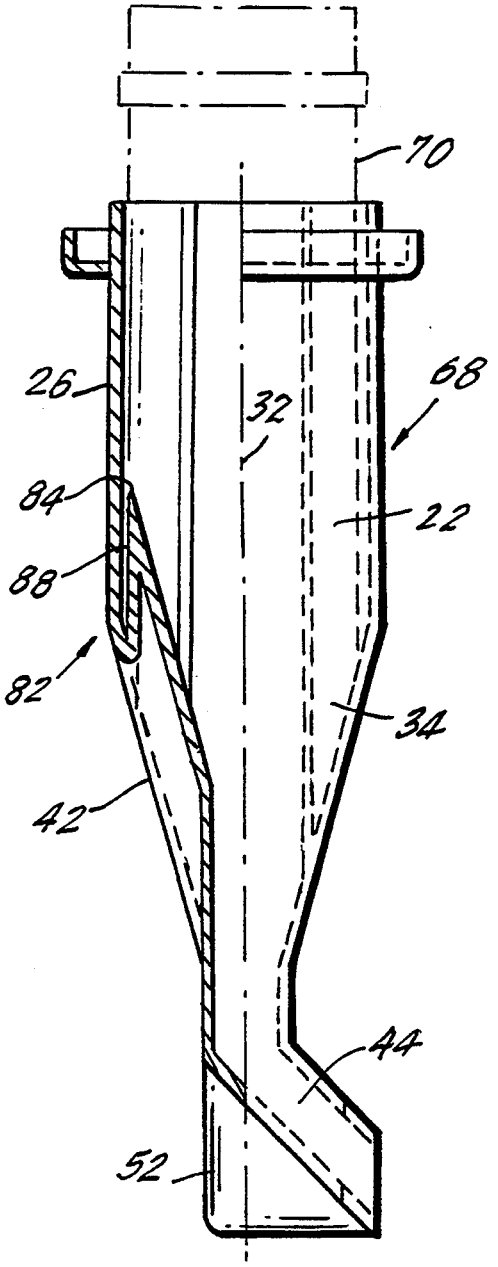
FIG. 7.
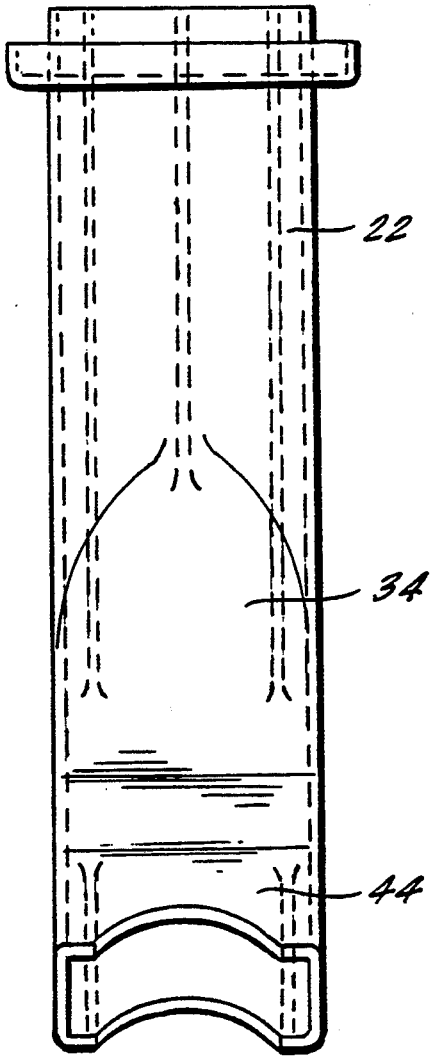
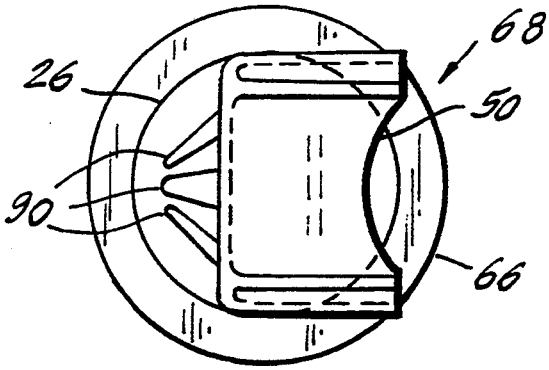
FIG. 8.

FIG. 9.
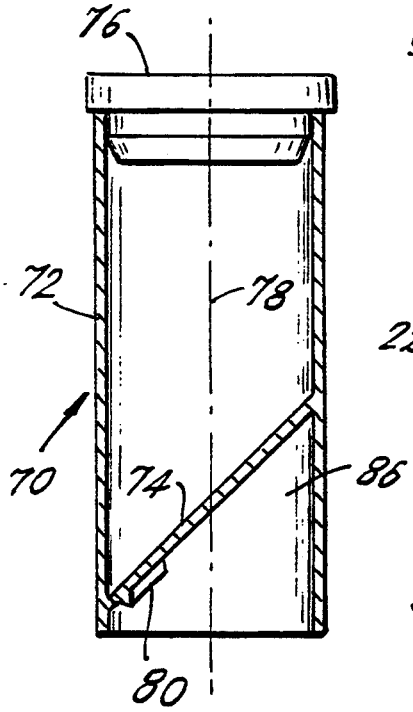
FIG. 11.
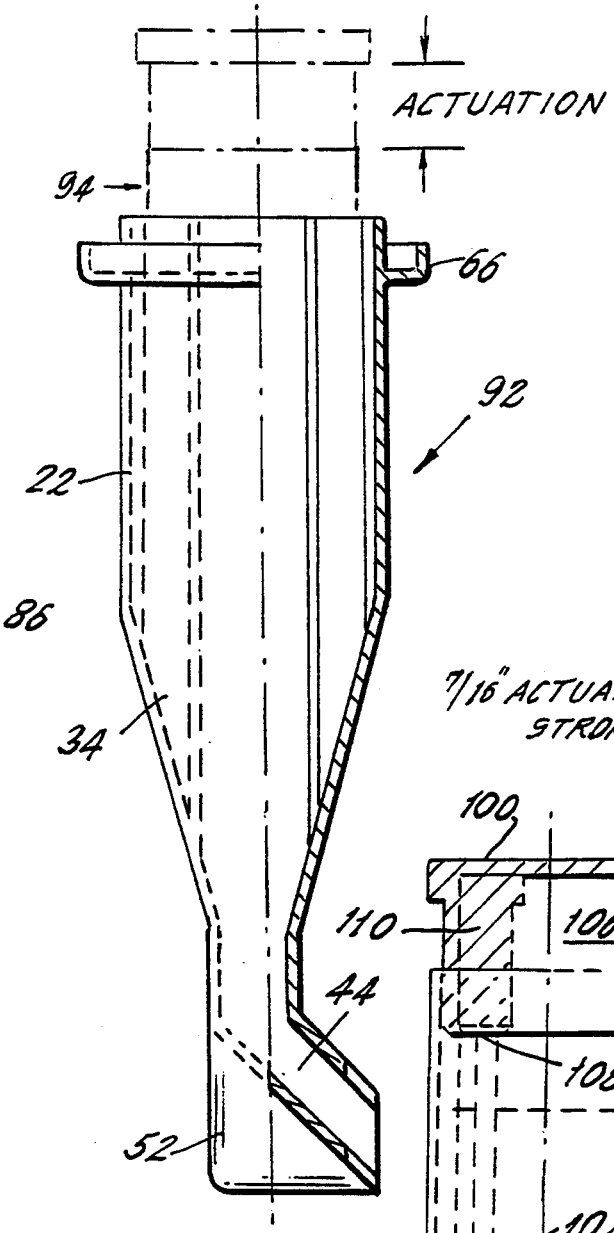
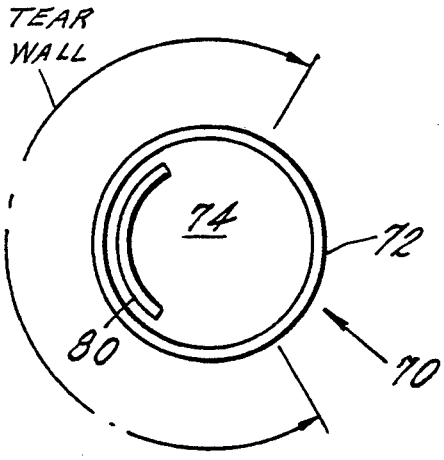
FIG. 10.
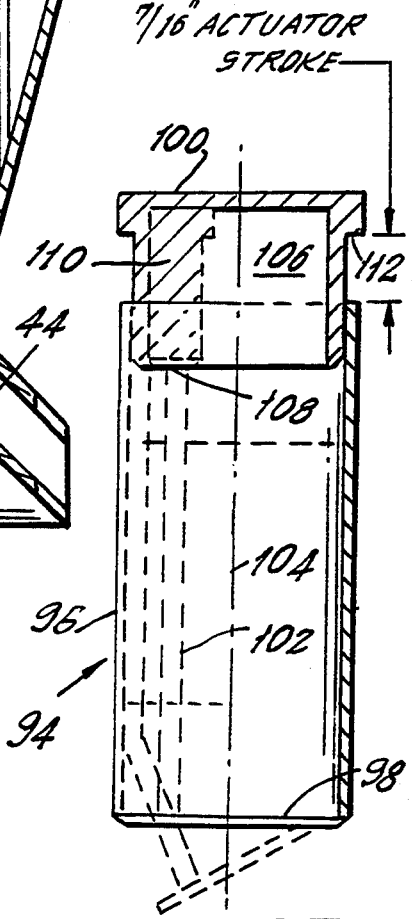
FIG. 12.

FIG. 17.
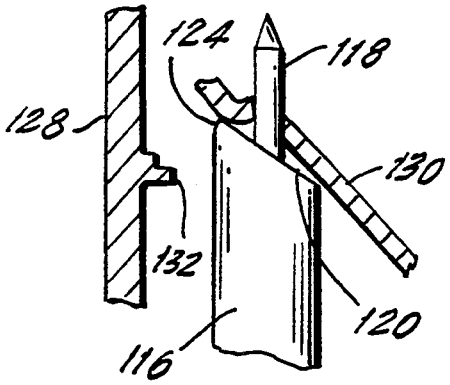
FIG. 18.
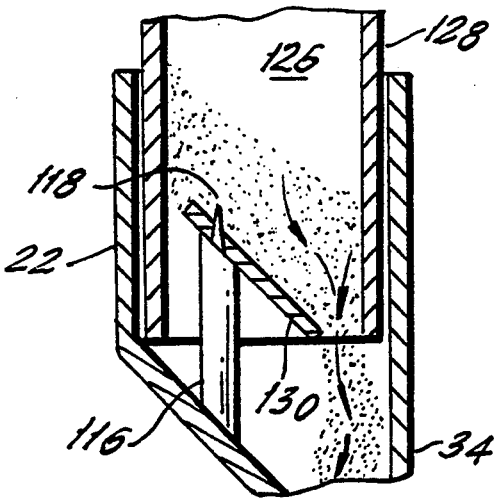
FIG. 19.
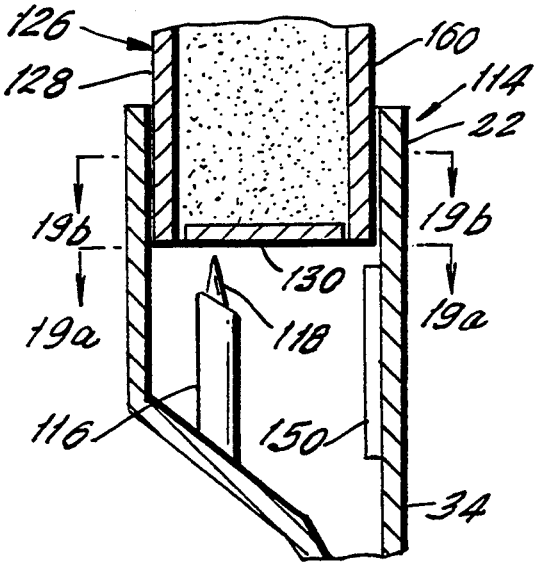
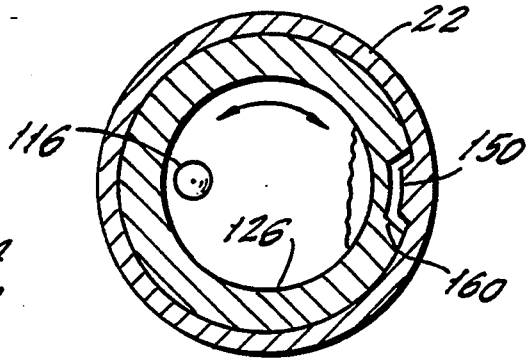
FIG. 19b.
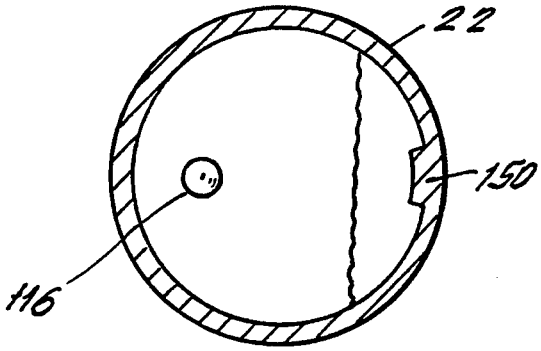
FIG. 19a.

DRAIN CLEANER DISPENSER WITH LOCKING FEATURE

This application is a division of application Ser. No. 07/824,160, filed Jan. 22, 1992, now U.S. Pat. No. 5,251,559, which is a continuation-in-part of application Ser. No. 681,953, filed Apr. 8, 1991, now U.S. Pat. No. 5,253,684.

BACKGROUND OF THE INVENTION

1. Field of the Invention

The present invention relates to a system for dispensing material, such as powdered drain cleaner, to a desired location, such as a drain.

2. Description of the Related Art

Powdered or granulated drain cleaner is conventionally packed in a bulk container. To clean a drain, a consumer must remove a cover from the container and them pour the cleaner into the drain. A spoon is often used to measure and handle the drain cleaner. This conventional method of cleaning a drain is inconvenient and messy and precautions must be taken to prevent the corrosive drain cleaner from getting on the consumer's skin.

The conventional method may also be imprecise. Drain cleaner is wasted when too much is used at one time. And when not enough drain cleaner is used, the drain remains clogged. This is also wasteful, since another application of drain cleaner must then be used.

SUMMARY OF THE INVENTION

The present invention overcomes the above-noted problems of the prior art. In accordance with the present invention, a substance such as powdered drain cleaner can be neatly, conveniently, and safely handled, and can be packaged in measured doses to reduce waste.

In one aspect, the present invention relates to a method of cleaning a drain, including the steps of: (A) supporting a dispenser in the vicinity of the drain; (B) while supporting the dispenser in the vicinity of the drain, opening a container within the dispenser by pushing downwardly on the container; (C) dispensing drain cleaner by gravity from the container, through the dispenser, and into the drain; and (D) reacting the drain cleaner with water within the drain. Prior to step (A), the container is unlocked relative to the dispenser.

In another aspect, the invention relates to a dispenser, including: (A) a sleeve for slidably receiving a container of material to be dispensed; (B) a funnel for conveying the material from the container by gravity, the funnel being axially aligned with and integrally connected to the sleeve; (C) a chute for conveying the material from the funnel by gravity to a desired location, the chute being integrally connected to the funnel and angled with respect to the central axis of the sleeve; (D) a base for supporting the dispenser, the base being in the vicinity of the chute; and (E) a pin for opening the container by rotating an end wall of the container, the pin being integrally connected to the funnel, extending upwardly within the sleeve, and being parallel to but off-center with respect to the axis of the sleeve. The dispenser includes means for locking the container and sleeve in respective positions which prevent use of the dispenser.

The invention also relates to a dispensing system which includes a container with an angled end wall and a dispenser for selectively storing the container and cutting the end wall to open the container.

The invention also relates to a container with a movable stem for opening a bottom end wall, and a plug with an open portion for receiving the top end of the stem and an actuating portion for pushing the stem downwardly.

The invention also relates to a dispenser with a pin for opening a container by separating a lower end wall from a side wall of the container. The pin has a point for piercing the lower end wall and a ledge for pushing upwardly on the lower end wall.

Other features and advantages of the present invention will become apparent from the following description of preferred embodiments of the invention, with reference to the accompanying drawings.

BRIEF DESCRIPTION OF THE DRAWINGS

For the purpose of illustrating the invention, there is shown in the drawings several forms which are presently preferred, it being understood however, that the invention is not limited to the precise arrangements and instrumentalities shown.

Figure 1:
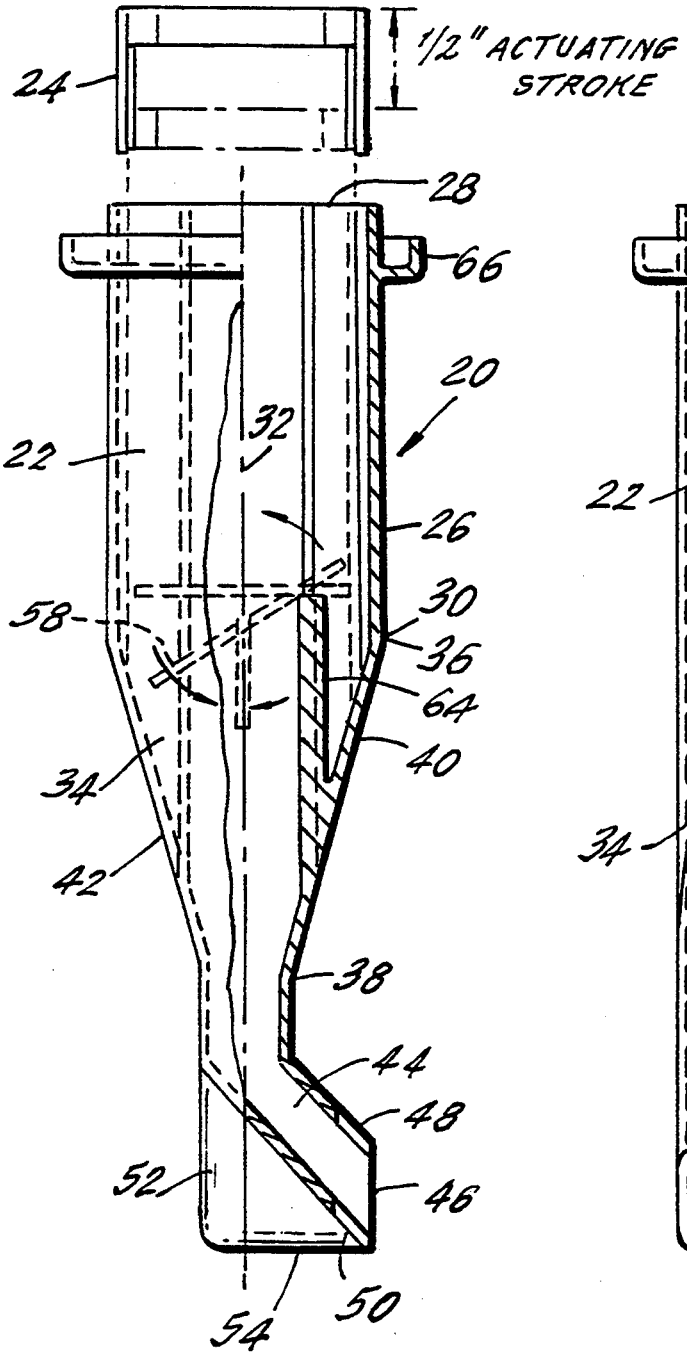
FIG. 1 is a partial cross-sectional side view of a dispenser in accordance with a first embodiment of the invention.
Figure 4:
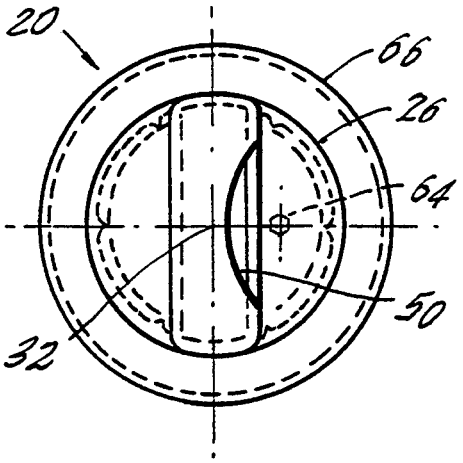
Figure 5:
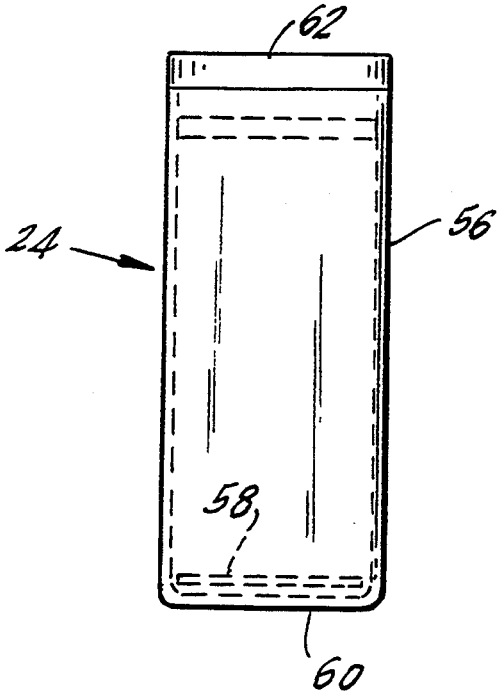
Figure 13:
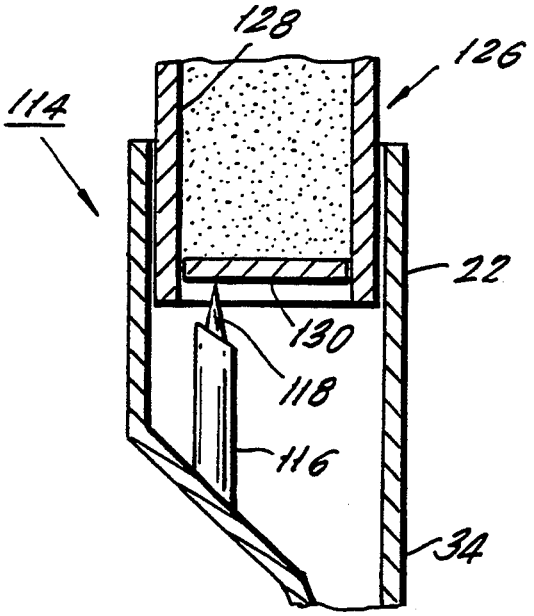
Figure 14:
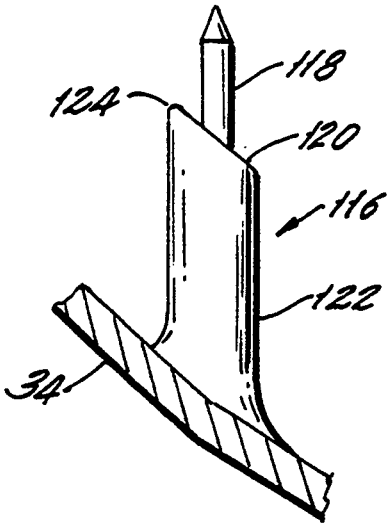
Figure 15:
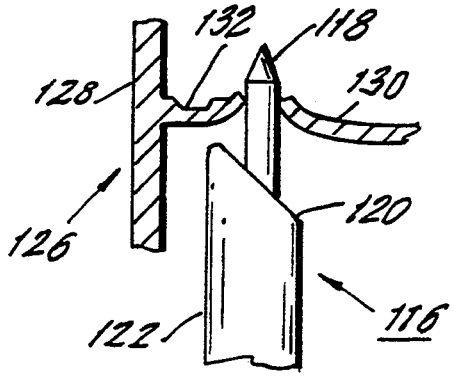
Figure 16:
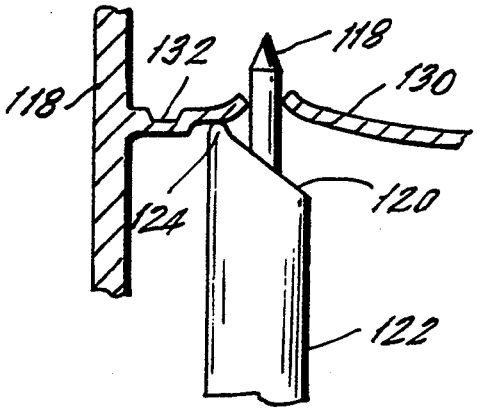

FIG, 3 is a bottom view of the dispenser of FIG. 1;

FIG. 4 is a bottom view of a dispenser in accordance with an alternative embodiment of the invention;

FIG. 5 is a side view of a canister for use with the dispenser of FIG. 1;

FIG. 6 is a partial cross-sectional side view of a dispenser in accordance with a second embodiment of the invention;

FIG. 7 is a front view of the dispenser of FIG. 6;

FIG. 8 is a bottom view of the dispenser of FIG. 6;

FIG. 9 is a partial cross-sectional side view of a canister for use with the dispenser of FIG. 6;

FIG. 10 is a bottom view of the canister of FIG. 9;

FIG. 11 is a partial cross-sectional side view of a dispenser in accordance with a third embodiment of the invention;

FIG. 12 is a partial cross-sectional side view of a canister for use with the dispenser of FIG. 11;

FIG. 13 is a cross-sectional view of a dispenser in accordance with a fourth embodiment of the invention;

FIG. 14 is a detailed view of a pointed pin of the dispenser of FIG. 13;

FIGS. 15–17 illustrate, in sequence, the operation of the dispenser of FIG. 13; and FIG. 18 is a cross-sectional view of the dispenser of FIG. 13, with a canister fully inserted therein;

FIG. 19 is a cross-sectional view of a dispenser in accordance with the invention including a locking means;

FIG. **19*a* is a cross-sectional view of the dispenser of FIG. 19 along line AA; and FIG. 19*b* is a cross-sectional view of the dispenser of FIG. 19** along line BB.

DETAILED DESCRIPTION OF THE PREFERRED EMBODIMENTS

Referring now to the drawings, wherein like reference numerals indicate like elements, there is shown in FIG. 1 a dispenser constructed in accordance with the principles of the present invention and designated generally as 20.

The dispenser 20 includes a ribbed sleeve 22 for receiving a container or canister 24 containing a desired amount of drain cleaner. The sleeve 22 has a cylindrical side wall 26 which defines an open top 28, an open bottom 30, and a central axis 32.

A funnel 34 for conveying the drain cleaner by gravity from the sleeve 22 is axially aligned with the central axis 32. The funnel 34 has an open circular top 36 which is integral with the bottom 30 of the sleeve 22. The funnel 34 tapers downwardly to an open bottom 38. The funnel 34 has flat sides 40, 42 which make a transition from the circular cross-section of the cylindrical sleeve 22 to a rectangular cross-section at the bottom 38.

Figure 2:
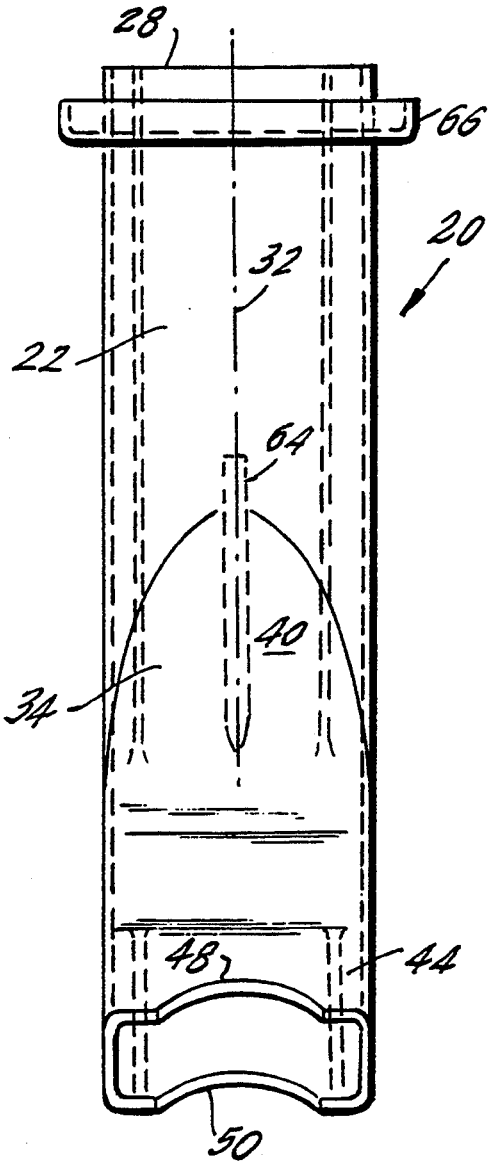
FIG. 2 is a front view of the dispenser of FIG. 1.
Figure 3:
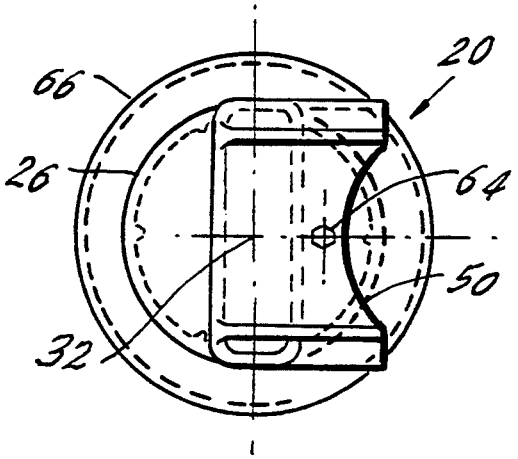

A chute 44 for conveying the drain cleaner into a drain (not illustrated) is integrally connected to the rectangular bottom 38 of the funnel 34. Preferably, the chute 44 makes a 45° angle with the axis 32. The end 46 of the chute 44 has a rectangular cross-section with cutout C-shaped sections 48, 50 (FIG. 2) so as to conform to the circular edge of the drain.

A base 52 (FIG. 1) for supporting the dispenser 20 in the vicinity of the drain is located directly beneath the angled chute 44. The base 52 is solid and extends downwardly to a bottom surface 54 which is even with the bottom of the chute 44.

In an alternative embodiment illustrated in FIG. 4, the chute is only as wide as the bottom of the funnel.

As illustrated in detail in FIG. 5, the canister 24 has a cylindrical side wall 56 which slidably matches the ribbed cylindrical side wall 26 of the sleeve 22. The bottom of the canister 24 is closed by a disk 58 which rests on edges 60 which are turned inwardly from the side wall 56. A plug 62 closes the top of the canister 24. The canister 24 is preferably a spiral wound canister and can be formed of many suitable materials.

A pin 64 (FIG. 1) for opening the canister 24 extends upwardly from the flat side 40 of the funnel 34. The pin 64 is parallel to but off-center with respect to the axis 32 and extends through the open bottom 30 and partially into the sleeve 22.

In operation, the dispenser 20 is preferably supported by placing the bottom surface 54 on the surface of a sink surrounding a drain with the C-shaped section 50 matching the circular edge of the drain. The canister 24 is then pushed downwardly into the sleeve 22. This causes the pin 64 to rotate the disk 58 into an open position (illustrated in dotted lines in FIG. 1). The powdered drain cleaner then falls by gravity from the opened canister 24, through the funnel 34 and the chute 44, and into the drain. Within the drain, the powdered drain cleaner reacts with water to release heat to clean the drain.

A gripping shoulder 66 for gripping the dispenser 20 during use is integrally connected to the sleeve 22, near the open top 28. The shoulder 66 surrounds the entire periphery of the sleeve 22.

A second embodiment of the invention is illustrated in FIGS. 6–10. The second embodiment and the first embodiment have many features in common. These features are indicated by the same reference numerals in the drawings so that their description need not be repeated. The second embodiment includes a dispenser 68 (FIGS. 6–8) which is adapted to store and open a canister 70 (FIGS. 9 and 10).

The canister 70 includes a cylindrical side wall 72, an angled bottom wall 74, and a plug 76. The bottom wall 74 preferably forms a 45° angle with respect to the axis 78 of the side wall 72 and is frangibly connected to the side wall 72 along at least a portion of its periphery. A C-shaped direction tab 80 is located in the vicinity of the frangible connection between the side wall 72 and the bottom wall 74.

The dispenser 68 includes a cutter 82 which extends upwardly from a side 42 of the funnel 34. The cutter 82 has a point 84 which is C-shaped (viewed along the main axis 32 of the dispenser 68). The cutter 82 is located on only one side of the dispenser 68 so that the canister 70 can fit within the sleeve 22 for storage without opening its lower end wall 74. That is, the canister 70 can be located within the sleeve 22 with the direction tab 80 on the side wall of the dispenser 68 opposite from the cutter 82 and with the point 84 (FIG. 6) fitting within an upper corner 86 (FIG. 9).

To dispense powdered drain cleaner from the canister 70, the canister 70 is lifted and then rotated through 180° such that the direction tab 80 is directly above the cutter 82. The canister 70 is then pushed downwardly such that the point 84 pierces the frangible connection between the bottom wall 74 and the side wall 72 of the canister 70. The cutter 82 continues on up within the canister 70 such that a C-shaped lower portion of the side wall 72 fits within an annular space 88 between the cutter 82 and the cylindrical sides 26 of the sleeve 22. During this process, the direction tab 80 ensures that the bottom wall 74 is torn away from the side wall 72 and is not stretched into the space 88 between the cutter 82 and the sleeve 22.

Powdered drain cleaner falls by gravity from the opened canister 70 through passageways 90 (FIG. 8) molded into the cutter 82. The dispenser 68 otherwise operates like the dispenser 20 of FIG. 1, with the powdered drain cleaner being conveyed through the funnel 34, chute 44, and then into the drain.

A third embodiment of the invention is illustrated in FIGS. 11 and 12. A dispenser 92 (FIG. 11) in accordance with the third embodiment is substantially identical to the dispenser 20 except that the dispenser 92 does not have the pin 64 of the dispenser 20.

The dispenser 92 is used to dispense powdered drain cleaner from a canister 94, illustrated in FIG. 12. The canister 94 is formed of plastic with a cylindrical side wall 96, a tear-away bottom 98, and a selectively orientable plug 100. An actuating stem 102 is integrally connected to the tear-away bottom 98 and extends almost to the other end of the canister 94. The stem 102 is parallel to but off-center with respect to a central axis 104 of the canister 94. The plug 100 has an open portion 106 for receiving the upper end 108 of the stem 102, a solid actuating portion 110, and shoulders 112 for limiting the extent to which the plug 100 can be pushed within the side wall 96.

Prior to use, the upper end 108 of the stem 102 is received within the open portion 106 while the shoulders 112 engage the top edge of the side wall 96.

To dispense powdered drain cleaner from the canister 94, the plug 100 is pulled upwardly away from the side wall 96 and then rotated through 180° such that the solid actuating portion 110 is located directly above the end 108 of the stem 102. The plug 100 is then pushed downwardly while gripping the shoulder of the dispenser 92. Since the canister 94 is too wide to move into the funnel 34, the stem 102 tears the bottom 98 away from the side wall 96. The stem 102 is preferably somewhat bendable and cooperates with the side wall 96 to facilitate the opening of the canister 94, as illustrated in dotted lines in FIG. 12. Powdered drain cleaner then falls from the opened canister 94 by gravity and is conveyed through the funnel 34, the chute 44, and into the drain, as in the first and second embodiment.

A dispenser 114 in accordance with a fourth embodiment of the invention is illustrated in FIGS. 13–18. The dispenser 114 has a pointed pin 116 but is otherwise identical to the dispenser 20 illustrated in FIG. 1. As illustrated in detail in FIG. 14, the pin 116 has a point 118 and a ledge 120. The pin 116 extends upwardly from the funnel 34 in a direction which is parallel to but spaced apart from the central axis of the sleeve 22.

The pin 116 consists of a cylindrical main portion 122, the ledge 120 and the point 118. The ledge 120 preferably forms a 45" angle with the central axis of the main portion 122. The upper edge 124 of the ledge 124 is slightly rounded.

Referring to FIG. 15, a canister 126 for use with the dispenser 114 has a side wall 128 and a lower end wall 130. The periphery 132 of the lower end wall 130 is frangibly connected to the side wall 128. Preferably, the canister 126 is molded of a low density polyethylene thermoplastic, and the lower end wall 130 is formed of a polyethylene or polypropylene slug which is molded into the bottom of the canister 126. The material in the canister 126 is filled through the bottom of the canister 126 and then the lower end wall 130 is molded in place.

In operation, as the canister 126 is pushed down into the sleeve 22, the lower end wall 130 is pierced by the point 118 (FIG. 15). This piercing does not by itself cause the lower end wall 130 to separate from the side wall 128. As illustrated in FIG. 16, as the canister 126 is pushed farther down into the sleeve 22, the rounded edge 124 of the ledge 120 abuts against a portion of the lower end wall 130. Since the edge 124 is not sharp, it pushes upwardly against and tears the lower end wall 130 away from the side wall 128 at the frangible periphery 132, as illustrated in FIG. 17. The lower end wall 130 is shown in its fully opened position in FIG. 18. As illustrated in FIG. 18, the point 118 remains pierced within the lower end wall 130, thereby preventing the wall 130 from falling into and clogging the funnel Each of the dispensers described above is advantageously formed as an integral unit, i.e., in one piece. The dispensers may thus be easily manufactured of styrene or a suitable thermoplastic using conventional molding techniques.

A locking mechanism for the invention is illustrated in FIGS. 19, 19*a* and 19*b* in connection with the fourth embodiment. The locking mechanism consists of a rectangular shaped protrusion or detent 150 formed along an inner surface of sleeve 22 and a slot 160 formed in the bottom portion of the sidewall 128 of canister 126. The protrusion 150 extends parallel to the central axis 32 shown in FIG. 1 and is slidably received within a complementary rectangular shaped slot 160 which is oriented longitudinally along an outer surface of canister 126 (when protrusion 150 and slot 160 are aligned as shown in FIGS. 19 and 19*b*). The protrusion 150 need not be axially elongated and can take other forms, for example it could be circular in shape with a diameter smaller than the width of slot 160. Slot 160 is also preferably parallel to the central axis 32 of dispenser 20. When protrusion 150 and slot 160 are not aligned, the lower end wall of canister 126 abuts the top of protrusion 150 preventing downward movement of canister 126 into sleeve 22. Thus, protrusion 150 and slot 160 cooperate (when not aligned) to lock dispenser 114, specifically, container 126 and sleeve 22, in a position relative to one another which prevents use of dispenser 114. When a user desires to dispense drain cleaner into a drain, canister 126 is rotated clockwise or counterclockwise (as shown by the arrows in FIG. 19b) with respect to sleeve 22 until protrusion 150 and slot 160 are aligned and then canister 126 is forced downward into sleeve 22.

Although the present invention has been described in connection with particular embodiments thereof, many other variations and modifications and other uses will become apparent to those skilled in the art. It is preferred, therefore, that the present invention be limited not by the specific disclosure herein, but only by the appended claims.

What is claimed is:

1. A method of cleaning a drain, comprising the steps of:

(A) unlocking a container of drain cleaner by moving the container from a locked position to an unlocked position relative to a dispenser for the drain cleaner to permit a predetermined movement of the container relative to the dispenser;

(B) supporting the dispenser in the vicinity of a drain;

(C) while supporting the dispenser in the vicinity of the drain, opening the container within the dispenser by causing the predetermined movement between the container and the dispenser;

(D) dispensing drain cleaner by gravity from the container, through the dispenser, and into the drain; and (E) reacting the drain cleaner with water within the drain.

2. The method of claim 1, wherein the drain cleaner is powdered drain cleaner.

3. The method of claim 1, wherein said unlocking step comprises the step of rotating the container relative to the dispenser.

4. A method of cleaning a drain, comprising the steps of:

5. The method of claim 4, wherein said first and second locking means are a groove and a detent, respectively.

(B) supporting the dispenser in the vicinity of a drain;

(C) while supporting the dispenser in the vicinity of the drain, openings the container within the dispenser by causing the predetermined movement between the container and the dispenser;

(D) dispensing drain cleaner by gravity from the containers through the dispenser, and into the drain; and (E) reacting the drain cleaner with water within the drain, wherein the unlocking step (A) comprises the step of rotating the container relative to the dispenser so as to cause first and second locking elements on said container and said dispenser, respectively, to come into alignment and permit downward movement of the container relative to the dispenser.

* * * * *